United States Patent [19]

Nakamura

[11] Patent Number: 4,934,945

[45] Date of Patent: Jun. 19, 1990

[54] ELECTRICAL CONNECTOR FORMING PLATE OVER PLATE ARRANGEMENT

[75] Inventor: Masahiko Nakamura, Nara, Japan

[73] Assignee: Hosiden Electronics Co., Ltd., Osaka, Japan

[21] Appl. No.: 362,985

[22] Filed: Jun. 8, 1989

[30] Foreign Application Priority Data

Jun. 17, 1988 [JP] Japan ..... 63-80990[U]

[51] Int. Cl.[5] ..... H01R 9/09

[52] U.S. Cl. ..... 439/75; 439/856

[58] Field of Search ..... 439/74, 75, 76, 81, 439/83, 436, 439, 547, 852, 821, 853, 856, 874, 876, 709, 44, 45, 57, 65, 69, 49, 31

[56] References Cited

U.S. PATENT DOCUMENTS 4,387,950 6/1983 Guzik et al. ..... 439/75

4,657,320 4/1987 Bamford et al. ..... 439/31

FOREIGN PATENT DOCUMENTS 62-28387 2/1987 Japan .

*Primary Examiner*—Eugene F. Desmond

*Assistant Examiner*—Walter G. Hanchuk

*Attorney, Agent, or Firm*—Armstrong, Nikaido, Marmelstein, Kubovcik & Murray

[57] ABSTRACT

The electrical connector forming a plate over plate arrangement is configured by a connector body, a plurality of female pins, male pins, and mount plates. Vertical through holes for insertion of the male pins and lateral holes for the female pins are provided with the connector body and intersecting respectively in the body, wherein a female pin each having a bifurcate portion at its tip is inserted into the lateral through hole so that the bifurcated portion is located at the intersection, and a male pin mounted on another plate to be connected is inserted in the vertical through hole. The bifurcated portion of the female pin each makes a contact with the male pin, when a plate mounted with male pins is approached closely to a plate mounted with a female pin-inserted connector body.

7 Claims, 5 Drawing Sheets

ELECTRICAL CONNECTOR FORMING PLATE OVER PLATE ARRANGEMENT

BACKGROUND OF THE INVENTION

This invention relates to an electrical connector which connects a number of two lead ends, forming a plate over plate arrangement, wherein the term "over" may be replaced by "under".

In the electronic industry, structuring of linkage through a plate over plate arrangement is needed in forming electrical connections, wherein it is desired for a plurality of substrate plates to be piled in layers keeping a small gap between two opposed plate faces. The prior art has enabled a connection of two plates, but has not always conveniently enabled the piling of three or more plates. Further, in the prior art a pin-to-socket contact has not always been firmly obtained in the above-mentioned manner and therefore, after the pin plate and the socket plate are engaged, it has been recommended for the two opposed plates to be displaced relatively to allow each pin to decline in a pincer type socket with the idea that thereby more contact will be produced.

However, such after-measures entail other disadvantages, for instance, the emergence of local unusual distortion or spontaneous relaxation of the pin and pocket plates back to their originally set status.

SUMMARY OF THE INVENTION

The present invention has resolved such disadvantages inherent in the prior art, and achieves not only firm pin-socket contacts, but also enables a structuring of three or more plates in a simple configuration, wherein increased pin-socket contacts may be obtained.

In other words, the present invention provides a connector unit or units which are suitable to form a hierachical connector assembly.

BRIEF DESCRIPTION OF THE DRAWINGS

FIGS. 1 to 5 show an embodiment of a connector body, wherein FIG. 1 shows a plan view thereof, partly broken, FIG. 2 shows a bottom view thereof, partly broken, FIG. 3 shows a side view thereof, FIG. 4 shows a sectional view with the same embodiment along the A—A line indicated in FIG. 1, and FIG. 5 shows a sectional view similar to FIG. 4 with a female pin removed.

Figure 1:
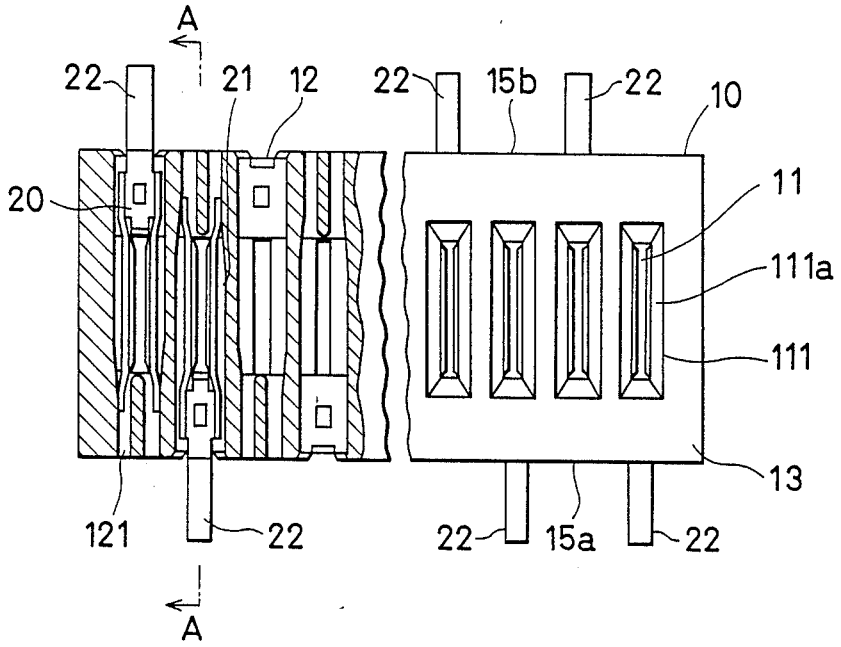

These drawings are present to illustrate the invention and therefore these should not be construed as limiting the invention.

DESCRIPTION OF THE PREFERRED EMBODIMENTS

With reference to FIGS. 1–5, a connector according to the present invention has a frame or body 10 which has a plurality of slender through holes 11, vertically and in parallel each other, each of which has an opening

111 fringed with a taper 111*a*. Each through hole 11 will be used for a male pin 31 to be inserted as will be apparent later. The body 10 has further a plurality of through holes 12, horizontally and in parallel with each other and intersecting with the hole 11 in the body. The through hole 12 will be used for a female pin 20 to be inserted as will be apparent later, and thereby the male pin 31 and the female pin 20 are contacted at each intersection.

Figure 2:
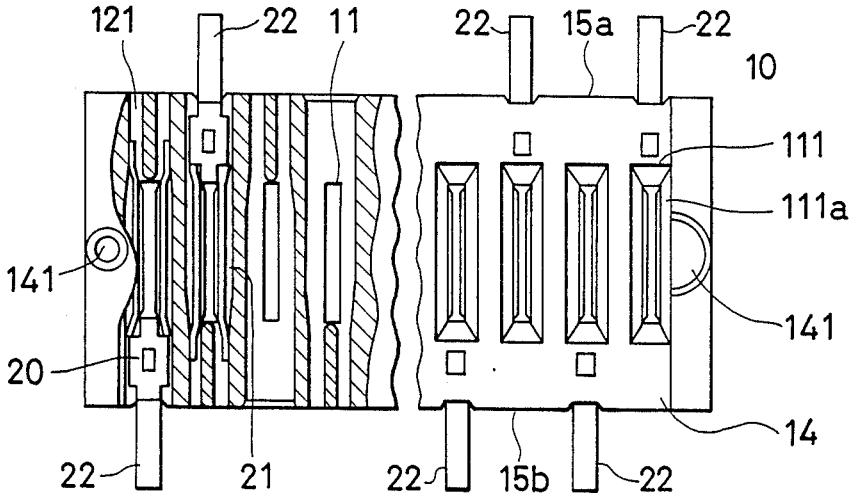
Figure 3:
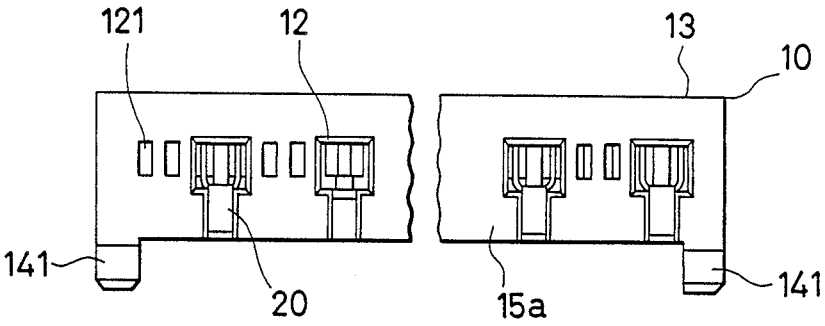
Figure 4:
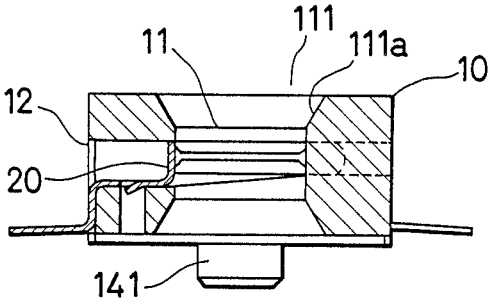
Figure 5:
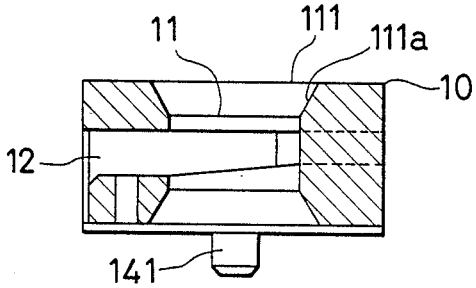

Specifically, the body 10 is shaped generally to be a flat box and is made by molding of a plastic. A plurality of the through holes 11 are provided across an upper face 13 and an bottom face 14 wherein at each opening 111, a tapering slope 111*a* is formed which will guide an inserting male pin 31. Further, across two side faces 15*a* and 15*b*, a plurality of the through holes 12 are provided to be square with the holes 11 so that two through holes 11, 12 intersect respectively at right angles. Therein the holes 12 are formed starting at the two side faces 15*a*, 15*b* alternately wherein each hole 12 has the same interior design, but each hole, as best seen in FIG. 5, has a narrowing profile as the hole bottom steps up and becoming two separated passages 121, as seen in FIG. 1 or 2, which terminates in a twin opening at the other side 15*a* or 15*b*.

Figure 7:
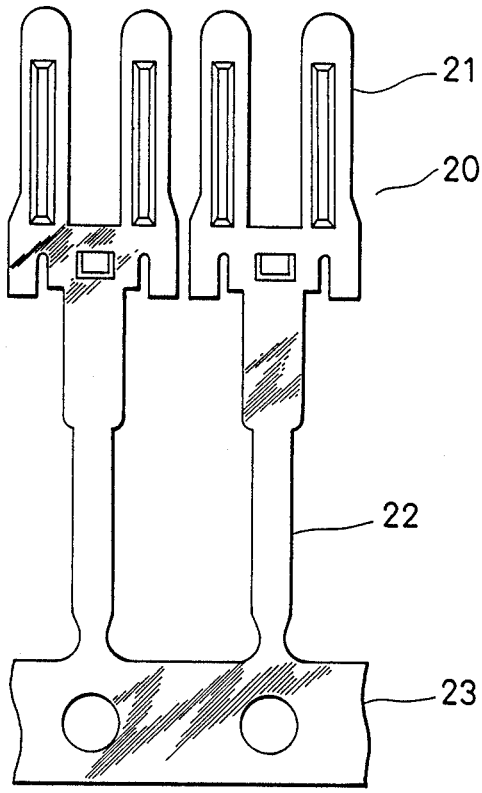
FIG. 7 shows a plan view of a few units of female pins which will take part of the connector.
Figure 10:
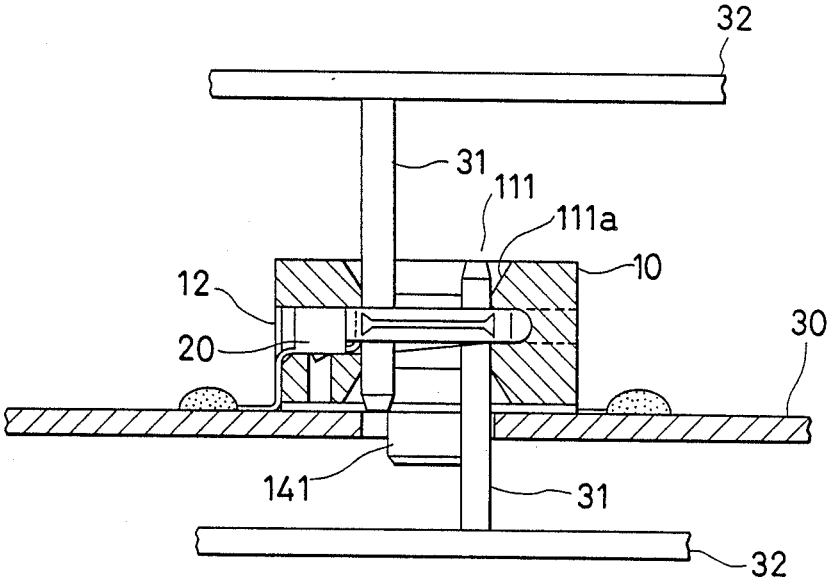

On the bottom of the body 10, a boss 141 is provided for positioning the body 10 when it is mounted on a plate 30 as seen in FIG. 10. Making reference to the female pin 20, as seen in FIG. 7, each unit has a shape of a bifurcate prong fork, wherein, when the pin 20 is inserted into the hole 12, a pair of front portions 21 are turned generally 90 degrees about a shank portion 22 so as to meet face to face with each other, and which will make a contact mount with a male pin 31 at the intersection, while further tip portions 21 are inserted into the two separate passage 121. Specifically, a pair of middle portions of each bifurcated portion 21 of the female pin will make a two hand socket or pincers, and the shank portion 22 will make a portional lead line and, at each base, shanks 22 are connected to one-piece with a tie bar 23 to form a lead frame.

Figure 8A:
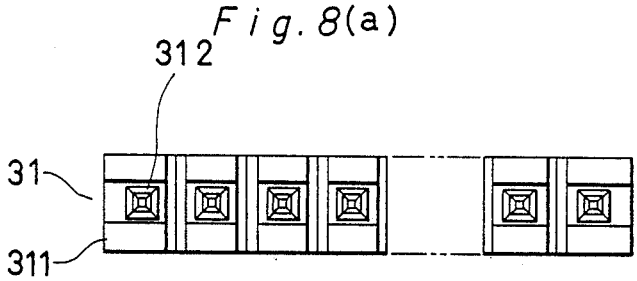
FIG. 8 shows a few different views of male pins which will take part of the connector, wherein (a) is a plan view, (b) is a front view, and (c) is a side view, respectively.
Figure 8B:
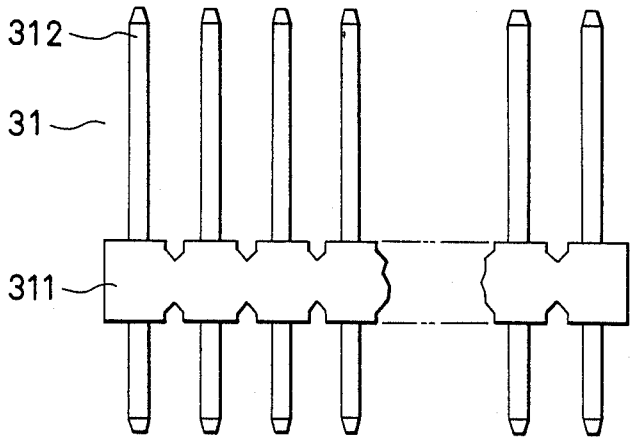
Figure 8C:
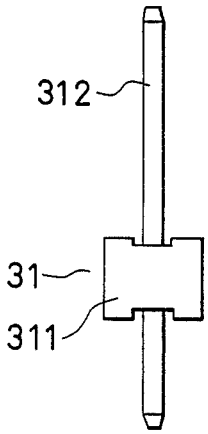

The male pin 31 has a shape as shown in FIGS. 8(*a*) to (*c*), wherein pins 312 are laterally connected in a one-piece arrangement with a tie bar 311 having a pitch between adjacent pins 312 equal to a pitch between the male holes 11 mentioned above. Each male pin 31 is first mounted, apart from the connector body 10, on a plate 32 above or below, as shown in in FIG. 10.

Figure 6:
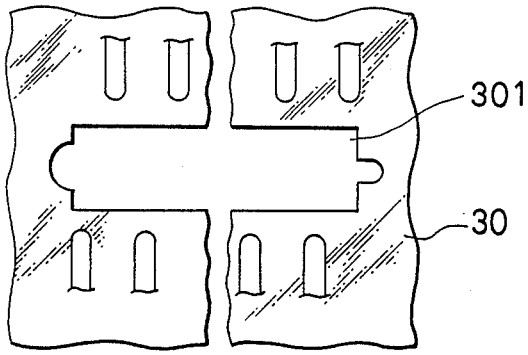
FIG. 6 shows a plan view of a plate on which the connector will be mounted.

Making reference to assembly of the inventive connector, first, a connector body 10 is mounted on a plate 30 as shown in FIG. 6, wherein a hole 301 is provided to receive the body 10, and the body 10 is engaged thereinto.

Figure 9:
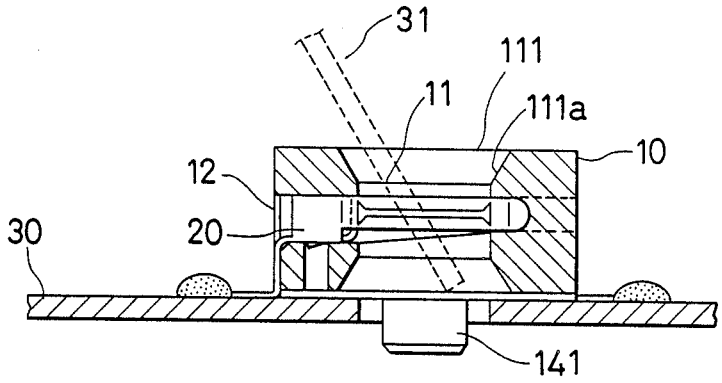
FIGS. 9 and 10 show elevational views for explaining a few applications of the connector.

Then, a certain number of male pins 30 each of which is priorly mounted on a plate 32 is inserted at the opening 111 into the through hole 11. During such insertion, it is recommended that the male pin plate 32 be kept inclined to the body plate 30. Specifically, a male pin 31 is inserted into a through hole 111 obliquely. (see FIG. 9) In the meantime, the male pin is assisted in entering the body 10 by a taper 111*a* and in the body, the tip portion of the male pin 31 is held by two pincer hands of a female pin 20, wherein the bifurcated contact portion of the female pin 20 is located in a narrow sectional space and therefore, contact pressure working on the male pin 31 is kept constant.

Another application of the inventive connector is illustrated in FIG. 10, wherein the connector or the connector plate 30 is employed for contacting two different male pin plates 32, positioned from above and below. In all three plate formations, the male pin 31 is made long enough to reach the connector plate 30, but not enough to reach the other opposite male pin plate.

Further, if length of a male pin is made long enough to be fed vertically through the two connector plates which are kept at intermediate heights between two male pin plates, although not shown herein, it is easily to understand that such an arrangement results in a four plate information.

What is claimed is:

1. An electrical connector comprising:

a box-shaped body having a plurality of through holes each of which is to receive a female pin therein, said box-shaped body having a plurality of elongated windows each of which is connected to one of said through holes for receiving a male pin through said elongated windows;

a plurality of female pins each being inserted into each of said through holes, each of said female pins having a shank portion and a pair of tip portions extending in parallel from a tip end of said shank portion with a uniform clearance therebetween, each of said tip portions being provided with an elongated ridge portion, said elongated ridge portions extending in parallel with and facing each other in order to hold a male pin therebetween.

2. The electric connector of claim 1, wherein each of said elongated windows is provided with tapered surfaces along an internal periphery thereof.

3. The electric connector of claim 1, wherein a pair of elongated windows is connected to each of said through holes provided above and below each of said through holes.

4. The electric connector of claim 1, wherein each of said through holes has a tapered surface.

5. The electrical connector of claim 1, wherein each of said through holes comprises two walls facing each other and allowing said tip portions to be situated therebetween parallel to said walls.

6. The electrical connector of claim 1, wherein each of said through holes has an inclined bottom such that the hole has a narrowing profile.

7. The electrical connector of claim 6, wherein said narrowing profile terminates in two separated passages for receiving respective ends of said pair of tip portions.

* * * * *